US005620575A

United States Patent [19]

Karasawa et al.

[11] Patent Number: 5,620,575

[45] Date of Patent: Apr. 15, 1997

[54] COMPOSITE PLATING APPARATUS AND APPARATUS FOR DISPERSING AIR BUBBLES WITHIN A COMPOSITE PLATING SOLUTION

[75] Inventors: Hitoshi Karasawa; Hiroyuki Nomura; Hisayuki Sakurai, all of Saitama, Japan

[73] Assignee: Honda Giken Kogyo Kabushiki Kaisha, JPX

[21] Appl. No.: 364,320

[22] Filed: Dec. 27, 1994

[30] Foreign Application Priority Data

Dec. 27, 1993 [JP] Japan ..... 5-348610
Dec. 27, 1993 [JP] Japan ..... 5-348611

[51] Int. Cl.[6] ..... C25D 7/04

[52] U.S. Cl. ..... 204/272; 204/275; 204/277; 204/297 R; 205/109; 205/131

[58] Field of Search ..... 205/109, 110, 205/131, 151; 204/272, 275, 277, 297 R

[56] References Cited

U.S. PATENT DOCUMENTS 3,706,646 12/1972 Gibson, Jr. et al. ..... 204/149
4,199,414 4/1980 Shum ..... 204/15

FOREIGN PATENT DOCUMENTS 1200410 7/1970 United Kingdom .

*Primary Examiner*—Kathryn L. Gorgos
*Assistant Examiner*—William T. Leader
*Attorney, Agent, or Firm*—Merchant, Gould, Smith, Edell, Welter & Schmidt

[57] ABSTRACT

A composite plating apparatus is disclosed in which an insertion electrode is loosely inserted into a hollow cylinder having a space, air bubbles are mixed into a composite plating solution fed from a liquid feeding pipe toward the space in the cylinder, and the hollow cylinder is connected to a base electrode so as to perform a composite plating on the inner surface of the hollow cylinder. An air bubble dispersing member having at least one passage hole with a diameter the same as or larger than a length of a gap defined between the insertion electrode and the inner surface of the cylinder is arranged upstream of a plating solution inlet portion of the hollow cylinder as an apparatus for dispersing air bubbles within the composite plating solution. The air bubble dispersing member can also be used as an electrode engaging member for engaging a tip end portion of the electrode inserted into the hollow cylinder.

10 Claims, 13 Drawing Sheets

COMPOSITE PLATING APPARATUS AND APPARATUS FOR DISPERSING AIR BUBBLES WITHIN A COMPOSITE PLATING SOLUTION

BACKGROUND OF THE INVENTION

1. Field of the Invention

The present invention relates to a composite plating apparatus capable of giving a composite plating on the surfaces of various members, particularly on the inner surface of a cylinder formed in a hollow member, by loosely inserting an electrode into the cylinder to form an annular space, by flowing composite plating solution in a gap defined between the electrode and the inner surface of the cylinder and by applying a voltage between The electrode and the hollow member, and to an apparatus for dispersing a composite plating solution to the composite plating apparatus.

2. Description of the Related Art

Conventionally, in order to improve wear resistance of, for example, the inner surfaces of automobile engine cylinders, an apparatus has been known in which a composite plating solution comprised of a nickel sulfate solution having fine grains of silicon carbide dispersed therein is passed through the cylinder to deposit the nickel and silicon carbide on the inner surface of the cylinder.

In such an apparatus as described above, the inner surface of the cylinder is generally plated by inserting an electrode into the cylinder with a space or clearance, by connecting the cylinder to the base electrode and by introducing a composite plating solution in the space between the electrode and the cylinder.

In order to improve the deposition effect of the fine grains on the inner surface of the cylinder, a method has been known where air is fed into the composite plating solution to generate air bubbles therein and the air bubbles are mixed into the composite plating solution flowing in the space between the electrode and the cylinder so that the air bubbles press the fine grains onto the inner surface of the cylinder. However, when the air bubbles are mixed into the composite plating solution flowing in the space of the cylinder, deposition of fine grains differs from spot to spot on the inner surface of the cylinder unless the air bubbles are uniformly dispersed within the plating solution. As a result, consistent quality cannot be obtained.

In the conventional apparatus, as shown in FIG. 16, the electrode to be inserted into the cylinder is supported only at the base end portion thereof. Thus, the annular space defined between the electrode and the inner surface of the cylinder cannot be securely maintained, thereby depositing the plating with nonuniform thickness. On the other hand, when the tip end of an electrode 51 is engaged with an engaging portion 52*a* of an electrode engaging member 52 so as to support the electrode 51 at both ends thereof the space S defined between the inner surface of the cylinder W and the electrode 51 can be held constant. However, the flow direction (the direction shown by the arrows) of the plating solution changes near the inlet of the cylinder, thereby causing uneven suspension of fine grains of silicon carbide so that the deposition of nickel and silicon carbide become inconsistent.

In FIG. 16, there are shown holding jigs 53 and 54 for holding a cylinder block W and an electrode supporting plate 55 for supporting a base end portion of the insertion electrode.

SUMMARY OF THE INVENTION

It is an object of the present invention to provide a composite plating apparatus and an apparatus for dispersing air bubbles into a composite plating solution capable of giving a composite plating on the inner surface of a cylinder with a uniform thickness and consistent quality in such a manner that the air bubbles are uniformly dispersed and the electrode is suitably supported to keep the annular space constant when composite plating is performed by loosely inserting an electrode into a cylinder formed in a hollow member and by flowing a composite plating solution having air bubbles mixed therein between the electrode and the inner surface of the cylinder.

In one embodiment of the present invention, there is provided an apparatus for dispersing air bubbles into a composite plating solution of the type in which an insertion electrode is loosely inserted into a hollow cylinder with a space and in which air bubbles are mixed into a composite plating solution fed from a liquid feeding pipe toward the space in the cylinder, and the air bubbles are dispersed in the composite plating solution so as to be fed into the space, wherein the apparatus includes an air bubble dispersing member arranged upstream of a plating solution inlet portion of the hollow cylinder, and a passage hole having a diameter of the same or larger width than the gap defined between the insertion electrode and the inner surface of the cylinder is formed therein. This feature of the invention offers the following advantages, The air bubbles approximately as large as the width of the gap can be dispersed uniformly and fed toward the space. When the air bubbles pass upwardly through the annular space, the effect of the fine grains in the plating solution being pressed onto the inner surface of the cylinder is improved, In another embodiment of the invention there is provided an apparatus for dispersing air bubbles into a composite plating solution, wherein the air bubble dispersing member includes a plurality of passage holes each having a diameter of the same or larger width as that of the gap, and small holes each having a diameter of the same or smaller width as that of the gap, or formed of a plurality of slots. This feature of the present invention offers the following advantages. The rigidity of the air bubble dispersing member can be maintained, and air bubbles adjusted to the shape of the space can be formed.

In a still another embodiment of the invention, there is provided an apparatus for dispersing air bubbles into a composite plating solution, wherein the sum of the cross-sectional areas of the passage holes formed in the air bubble dispersing member is approximately the same as the cross-sectional area of the space in the cylinder. This feature of the invention offers the advantage that the composite plating solution can flow smoothly.

In a further embodiment of the invention, there is provided an apparatus for dispersing air bubbles into a composite plating solution, wherein a central hole opened at the center of the inlet portion for the composite plating solution is formed by communicating with a plurality of peripheral holes opened at the peripheral portion of the outlet portion for the composite plating solution. This feature of the invention offers the following advantages. The air bubbles passing through the central portion of the bubble dispersing member can be approximately dispersed into the peripheral holes formed around the air bubble dispersing member, and uniform dispersion of the air bubbles can be obtained.

In another embodiment of the invention, there is provided an apparatus for dispersing air bubbles into a composite plating solution, wherein passage holes for passing the composite plating solution therethrough and feeding holes for feeding gases are separately and distinctly formed in the air bubble dispersing member. This feature of the invention offers the advantage that the dispersion of the air bubbles can be effectively controlled.

In another embodiment of the invention, there is provided a composite plate apparatus of a type in which an insertion electrode is loosely inserted into a hollow cylinder and in which a composite plating solution fed from a liquid feeding pipe is introduced into the space in the cylinder so as to perform composite plating on the inner surface of said hollow cylinder, wherein the apparatus comprises an electrode engaging member arranged upstream of a plating solution inlet portion of the hollow cylinder having a plurality of passage holes for engaging a tip end portion of the insertion electrode, and for communicating the liquid feeding pipe with the inside of the hollow cylinder. This feature of the invention offers the following advantages. The position of the insertion electrode can be stabilized and a gap formed between the insertion electrode and the inner surface of a cylinder can be kept constant. The composite plating solution flows smoothly and the deposit thickness can be formed uniformly.

In another embodiment of the invention, there is provided a composite plating apparatus wherein the plurality of passage holes of the electrode engaging member are formed of large and small holes, or formed of a plurality of slots. This feature of the invention offers the following advantages. The rigidity of the electrode engaging member can be maintained. The large air bubbles can be introduced into the cylinder and the effect of the fine grains of silicon carbide in the plating solution being pressed on the inner surface of the cylinder is improved.

In a further embodiment of the invention, there is provided a composite plating apparatus wherein the sum of the cross-sectional areas of the plurality of passage holes of the electrode engaging member is approximately the same as a cross sectional area of the space in the cylinder. This feature of the invention offers the advantage that the plating solution can flow more smoothly.

In yet another embodiment of the invention, there is provided a composite plating apparatus wherein the electrode engaging member includes an inlet portion and an outlet portion for the composite plating solution, and the plurality of passage holes include a dispersing hole for communication of a central hole opened at the center of the inlet portion with a plurality of peripheral holes opened at the peripheral portion of the outlet portion. This feature of the invention allows the air bubbles passing through the central portion of the bubble dispersing member to be approximately dispersed into the peripheral holes formed around the air bubble dispersing member, and a uniform degree of dispersion of the air bubbles can be obtained.

In a yet further embodiment the invention, there is provided a composite plating apparatus wherein part of the plurality of passage holes of the electrode engaging member communicate the liquid feeding pipe with the inside of the hollow cylinder and the rest are formed as gas feeding holes. This feature of the invention offers the advantage that the dispersion of the air bubbles can be effectively controlled.

BRIEF DESCRIPTION OF THE DRAWINGS

FIG. 5(*b*) is a cross sectional view taken on line Vb—Vb of FIG. 5(*a*);

FIG. 7(*b*) is a cross sectional view taken on line VIIb—VIIb of FIG. 7(*a*);

FIG. 13(*b*) is a cross sectional view taken on line XIIIb—XIIIb of FIG. 13(*a*);

FIG. 15(*b*) is a cross sectional view taken on line XVb—XVb of FIG. 15(*a*)

DESCRIPTION OF THE PREFERRED EMBODIMENTS

The preferred embodiments of the present invention will be described with reference to the accompanying drawings.

Figure 1:
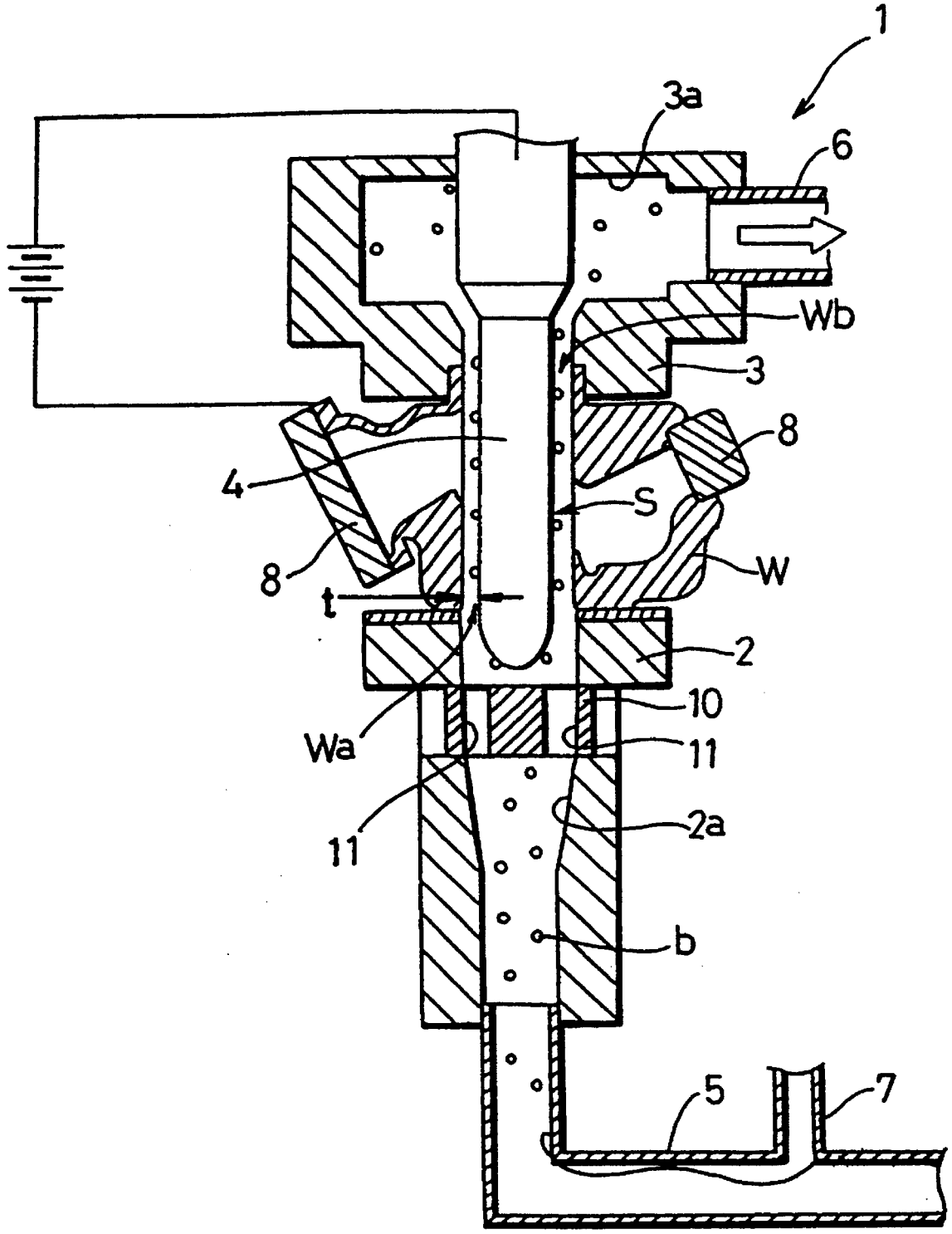
FIG. 1 is a longitudinal sectional view showing a main part of a composite plating apparatus according to a first embodiment of the present invention.

FIG. 1 is a longitudinal sectional view showing a main part of a composite plating apparatus according to a first embodiment of the present invention. As shown in FIG. 1, a composite plating apparatus 1 is constructed so as to perform composite plating on the inner surface of a cylinder block W mounted on a jig pad 2. An upper surface of the cylinder block W having at least one cylinder defined therein is held by a holding jig 3. An insertion electrode 4 is loosely inserted from above into the cylinder with an annular space S or clearance, and a composite plating solution is introduced into the space S. Only a base end portion of the insertion electrode 4, that is to say, an upper end portion of the insertion electrode 4 shown in FIG. 1 is supported by the holding jig S or a supporting member (not shown) arranged above the holding jig 3.

Communicating holes 2*a* and 3*a* capable of flowing plating solution therethrough are formed inside of the lower jig pad 2 and the upper holding jig 3, respectively. The communicating hole 2*a* of the lower jig pad 2 is formed for communication of a liquid feeding pipe 5 with a plating solution inlet portion Wa of the cylinder. The communicating hole 2*a* of the upper holding jig 3 is formed for communication of a plating solution outlet portion Wb with a return pipe 6. A composite plating solution tank and a pressure pump, etc. (not shown) are provided upstream of the liquid feeding pipe 5, and an air feeding pipe 7 is connected to the liquid feeding pipe 5 at a midpoint thereof. The composite plating solution was prepared in the following manner. To one liter of water were added 400 g of nickel sulfate, 35 g of boric acid and 95 g of saccharin-sodium, and the hardness of the mixture was controlled. The pH of the mixture was 4. In the mixture, 60 g of fine grains of silicon carbide were suspended to obtain the composite plating solution.

Since a plurality of openings are provided in the cylinder block W, they are covered with sealing members 8, 8, respectively.

The composite plating solution, having air bubbles b generated by air fed through the air feeding pipe 7 dispersed therein is fed under pressure through the liquid feeding pipe 5 to the plating solution inlet portion Wa, and flows into the space S of the cylinder block W when the plating solution flows through the inside of the cylinder, a current is passed between the insertion electrode 4 and the cylinder block W to perform composite plating on the inner surface of the cylinder. The mixed plating solution flowing out of the plating solution outlet portion Wb is returned through the return pipe 6 to the plating solution tank.

The flow rate of the composite plating solution in the space S of the cylinder block W is set, for example, at about 15 cm/s. However, the air bubbles b mixed into the composite plating solution move upwardly faster than the flow rate, and press the fine grains of silicon carbide suspended in the composite plating solution onto the inner surface of the cylinder while moving upwardly, thereby improving the deposition of the fine grains of the silicon carbide.

In a first embodiment according to the present invention, an air bubble dispersing member 10 is provided upstream of the plating solution lead-in portion Wa.

Figure 2:
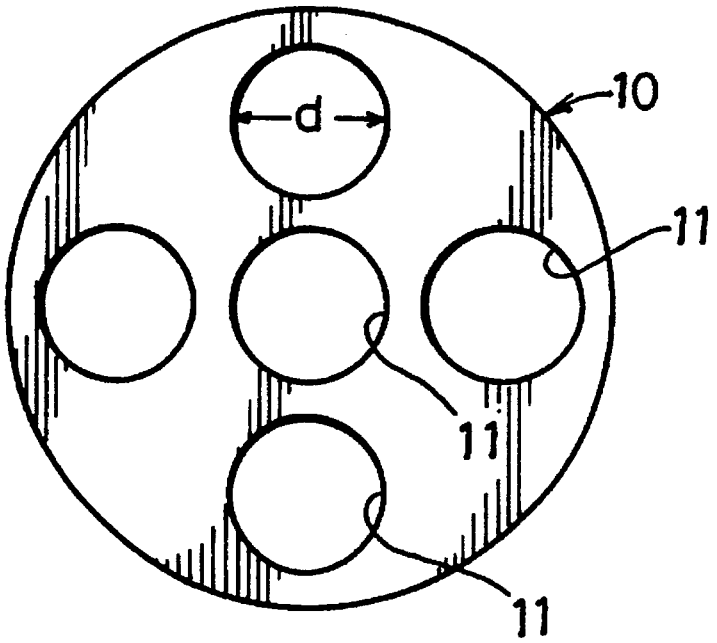
FIG. 2 is a plan view of an air bubble dispersing member of the composite plating apparatus shown in FIG. 1 showing a first pattern of the passage holes (a plurality of passage holes each having the same diameter) formed therein.

The bubble dispersing member 10 is provided at a midpoint of the communication hole 2*a* of the jig pad 2, as shown in FIG. 1 and includes plating solution passage holes 11 comprising a plurality of circular holes as shown in FIG. 2.

The diameter d of the plating solution passage holes 11 is as wide or wider than the gap t of the annular space S. Also, the sum of the cross-sectional areas of the plurality of the plating solution passage holes 11 is approximately equal to the cross-sectional area of the annular space S.

In the composite plating apparatus 1 as described above, the cylinder block W is mounted on the regular position of the jig pad 2. The cylinder block W is held from above by the holding jig 3, and the insertion electrode 4 is loosely inserted into the cylinder forming the annular space S. When the composite plating solution is fed through the liquid feeding pipe 5 and the air is fed into the composite plating solution through the air feeding pipe 7, the composite plating solution including air bubbles b is flowed toward the plating solution inlet portion Wa. The composite plating solution, including bubbles, passes through the plating solution passage holes 11 of the air bubble dispersing member 10, and at this time air bubbles b larger than those shown in FIG. 1 are dispersed so as to be fed toward the plating solution lead-in portion Wa. As a result, the air bubbles b having a diameter up to the gap width t can be passed through the space S, thereby improving the effect of the fine grains of silicon carbide suspended in the plating solution being pressed to the inner surface of the cylinder. Furthermore, since the sum of the areas of the passage holes 11 for passing the plating solution therethrough is approximately equal to the area of the space S, the plating solution can flow smoothly.

When a voltage is applied between the insertion electrode 4 and the cylinder block W, nickel and silicon carbide are deposited on the inner surface of the cylinder. And, since the air bubbles b are dispersed in the composite plating solution, the silicon carbide to be deposited can be homogenized.

In this connection the cathode current density at this time is approximately 28 $A/dm^2$.

The passage holes to be formed in the air bubble dispersing member are not limited to the passage holes 11 as shown in FIG. 2, and various patterns of passage holes for dispersing air bubbles can be adopted as described below.

Figure 3:
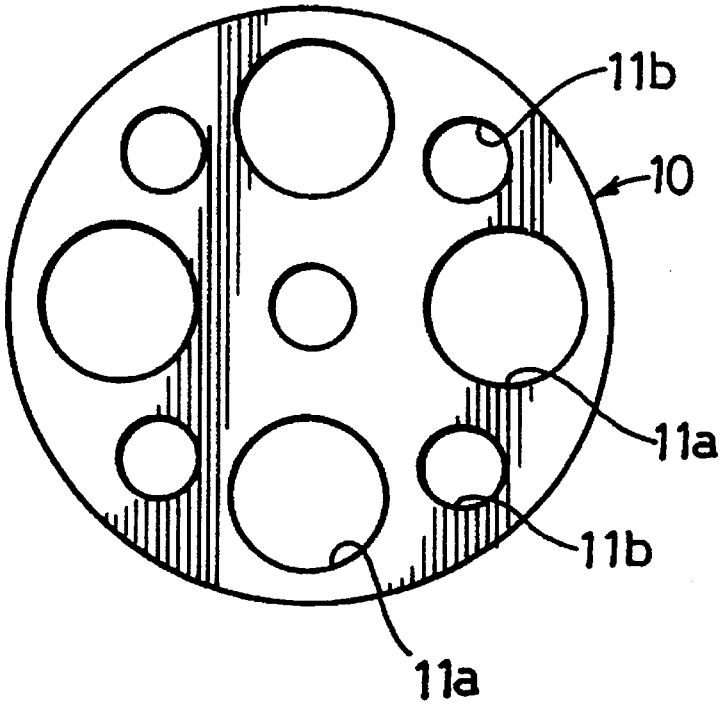
FIG. 3 is a plan view of the air bubble dispersing member of the composite plating apparatus shown in FIG. 1 showing a second pattern of the passage holes (large and small passage holes) formed therein.

FIG. 3 shows the second pattern of the passage holes in which passage holes 11*a* having a large diameter are formed in the bubble dispersing member 11 in combination with passage holes 11*b* of a smaller diameter. The size of the large diameter passage holes 11*a* is larger than the gap of the annular space S, whereas the size of the small diameter passage holes 11*b* is smaller than the gap t of the annular space S so as to maintain the rigidity of the air bubble dispersing member 10 as much as possible. In this case, for example, the passage holes 11*a* are arranged to face the lower part of the space S.

Figure 4:
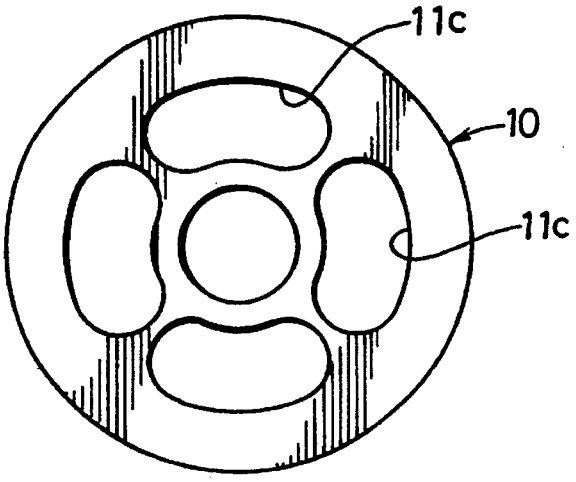
FIG. 4 is a plan view of the air bubble dispersing member of the composite plating apparatus shown in FIG. 1 showing a third pattern of the passage holes (passage holes formed into slots) formed therein.

FIG. 4 shows a third pattern of the passage holes in which the passage holes 11 are formed into slots 11*c* so that the size of the air bubbles b can be enlarged. That is to say, in this pattern, four slots or oblong holes 11*c* are formed on the air bubble dispersing member 10 and spaced from each other by an equivalent angular distance on the periphery thereof so that the outer circular arcs of the slots 11*c* are approximately matched with the internal diameter of the cylinder, and the inner circular arcs of the slots are approximately matched with the outer diameter of the insertion electrode 4 and the space S can be almost filled flowing air bubbles b can be flown in the space S, thereby improving the effect of the fine grains of silicon carbide suspended in the plating solution being pressed to the inner surface of the cylinder.

Figure 5:
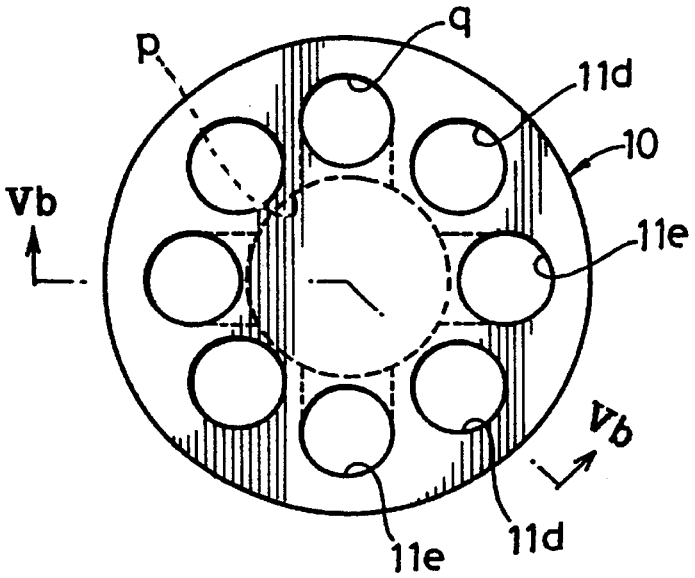
FIG. 5(*a*) is a plan view of the air bubble dispersing member of the composite plating apparatus shown in FIG. 1 showing a fourth pattern of the passage holes (combination of direct passage holes and dispersing holes) formed therein.
Figure 5:
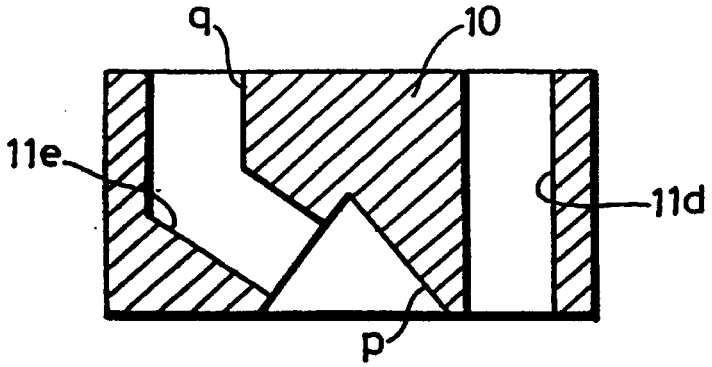

FIGS. 5(*a*) and 5(*b*) show a fourth pattern of passage holes in which direct passage holes 11*d*, merely passing through in an upward direction, and dispersing holes 11*e*, formed in the upper face of the air bubble dispersing member 10 and communicating with a central hole p formed in the lower face of the air bubble dispersing member 10 are formed in the bubble dispersing member 10 alternately four times around the circumference thereof.

The air bubbles b moving upwardly along the outer periphery of the communicating hole 2*a* go upward as they pass through the direct passage holes 11*d*, and the air bubbles b moving upwardly along the center portion of the communicating hole 2*a* are dispersed to the outer periphery by means of the dispersing holes 11*e*, thereby increasing the degree of dispersion of air bubbles b.

In the first embodiment according to the present invention as described above, both the plating solution and the air bubbles b, i.e. the composite plating solution flowing in the liquid feeding pipe 5 to which air bubbles b are fed through the air feeding pipe 7, is passed through various passage holes 11 formed in the air bubble dispersing member 10.

Figure 6:
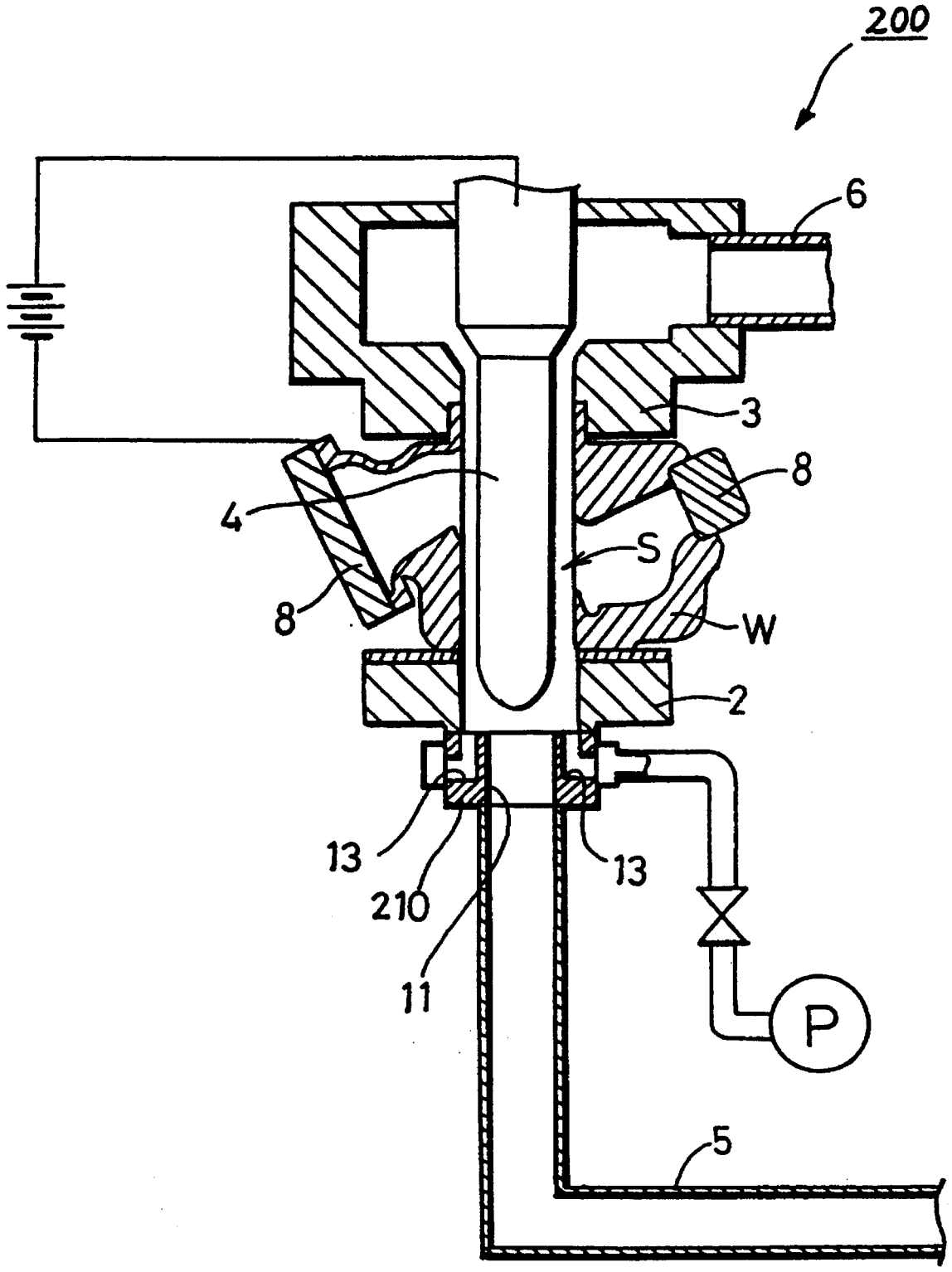
FIG. 6 is a longitudinal sectional view showing a main part of a composite plating apparatus according to a second embodiment of the present invention.
Figure 7:
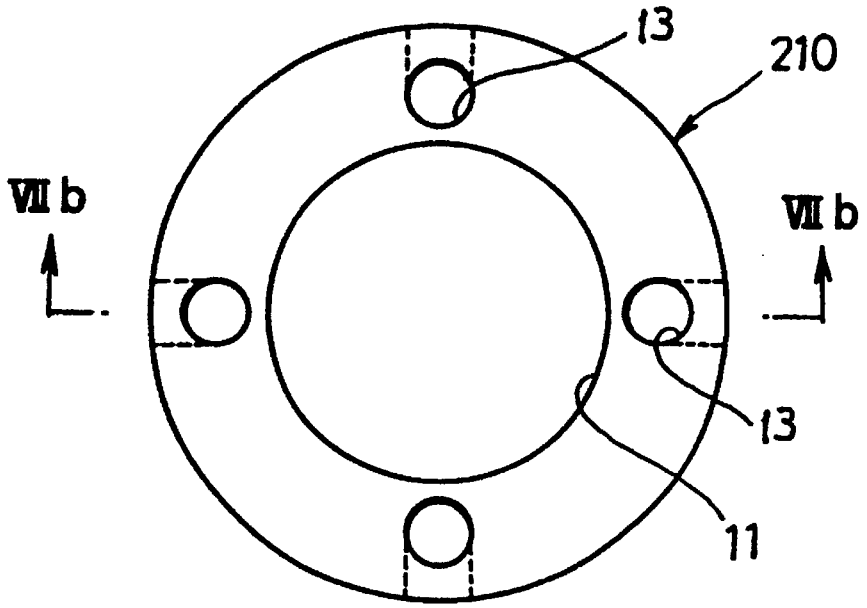
FIG. 7(*a*) is a plan view of an air bubble dispersing member to be used in the composite plating apparatus shown in FIG. 6.
Figure 7:
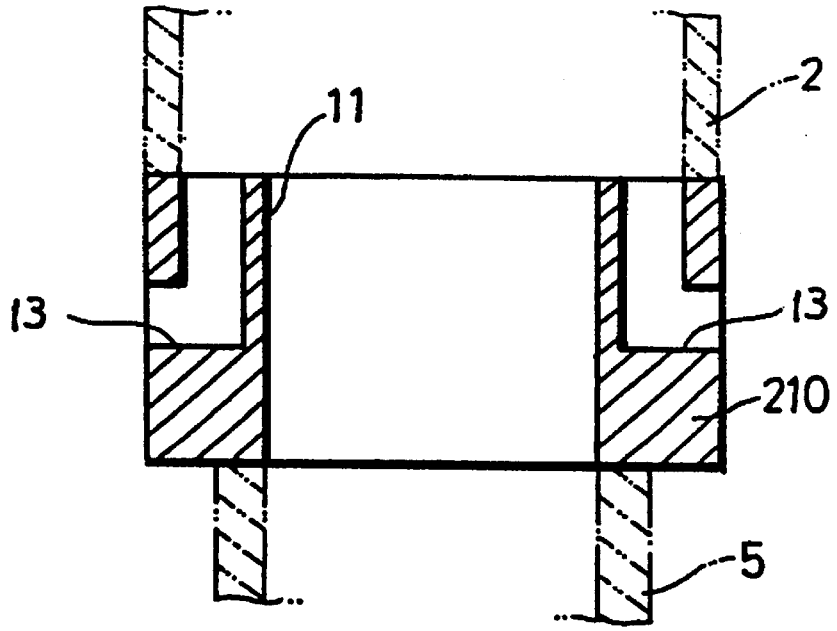

FIGS. 6, 7(*a*) and 7(*b*) show a composite plating apparatus 200 according to a second embodiment of the present invention. As shown in FIG. 6, plating solution passage holes 11 and air feeding hole 13 are separately and distinctly formed in an air bubble dispersing member 210 in the composite plating apparatus 200. Thus, according to this embodiment, the air is fed through the air feeding holes 13 in place of the air feeding pipe 7 shown in FIG. 1.

As shown in FIGS. 7(*a*) and 7(*b*), four air feeding holes 13 are equally spaced along the circumference of the air bubble dispersing member 210. In this case, the dispersion of the air bubbles b can be effectively controlled because the air can be fed from any direction.

Various members in the composite plating apparatus 200 according to the second embodiment of the present invention are approximately the same as those in the composite plating apparatus 1 of the first embodiment except for the air bubble dispersing member 210 as described above. Thus, the members shown in FIGS. 6 to 7(*b*) are indicated by the same reference numerals as in the first embodiment.

In the composite plating apparatus according to the first and second embodiments of the present invention, an air bubble dispersing member which comprises passage holes each having a diameter the same as or larger than the gap width t of the annular space formed between the inner surface of a hollow cylinder and an electrode inserted in the hollow cylinder is provided upstream of a plating solution inlet portion. By this, the air bubbles having a size approximately up to the gap width of the annular space can be passed through the annular space, and the amount of fine grains in the composite plating solution to be co-deposited on the surface of the cylinder can be made uniform.

Also, the rigidity of the air bubble dispersing member can be easily secured by forming large and small passage holes in combination in the air bubble dispersing member 11. Also, by forming the passage holes into slots, air bubbles adjusted to the shape of the space can be formed.

Further, since the sum of the cross-sectional area of the passage holes is approximately the same as the cross-sectional area of the annular space in the cylinder, the composite plating solution can flow smoothly.

Still further, by forming a central hole as a passage hole in the air bubble dispersing member which is opened at the central portion of the inlet portion of the composite plating solution so as to communicate with a plurality of peripheral holes, air bubbles passing through the central portion of the bubble dispersing member can be approximately dispersed into the peripheral holes formed around the air bubble dispersing member, and a uniform degree of dispersion of the air bubbles can be obtained.

Moreover, by forming the passage hole for passing the composite plating solution therethrough to be separate and distinct from the feeding holes for feeding gases in the air bubble dispersing member, the dispersion of the air bubbles can be effectively controlled.

Composite plating apparatuses 300 and 400 according to a third and fourth embodiments of the present invention will now be described.

In the first and second embodiments as described above, only the base end portion of the insertion electrode 4 is supported by the holding jig 3 or a supporting member arranged above the holding jig 3. However, in the composite plating apparatus according to the third and fourth embodiments, both of the base end portion and the tip end portion of the insertion electrode 4 are supported.

All of the members in the composite plating apparatuses 300 and 400 according to the third and fourth embodiment of the present invention are approximately same as those in the composite plating apparatuses 100 and 200 according to the first and second embodiments except for the air bubble dispersing members (or electrode engaging members) 310 end 410. Thus, each of the members shown in FIGS. 8 to 15 is indicated by the same reference numerals as in the first and second embodiments.

Figure 8:
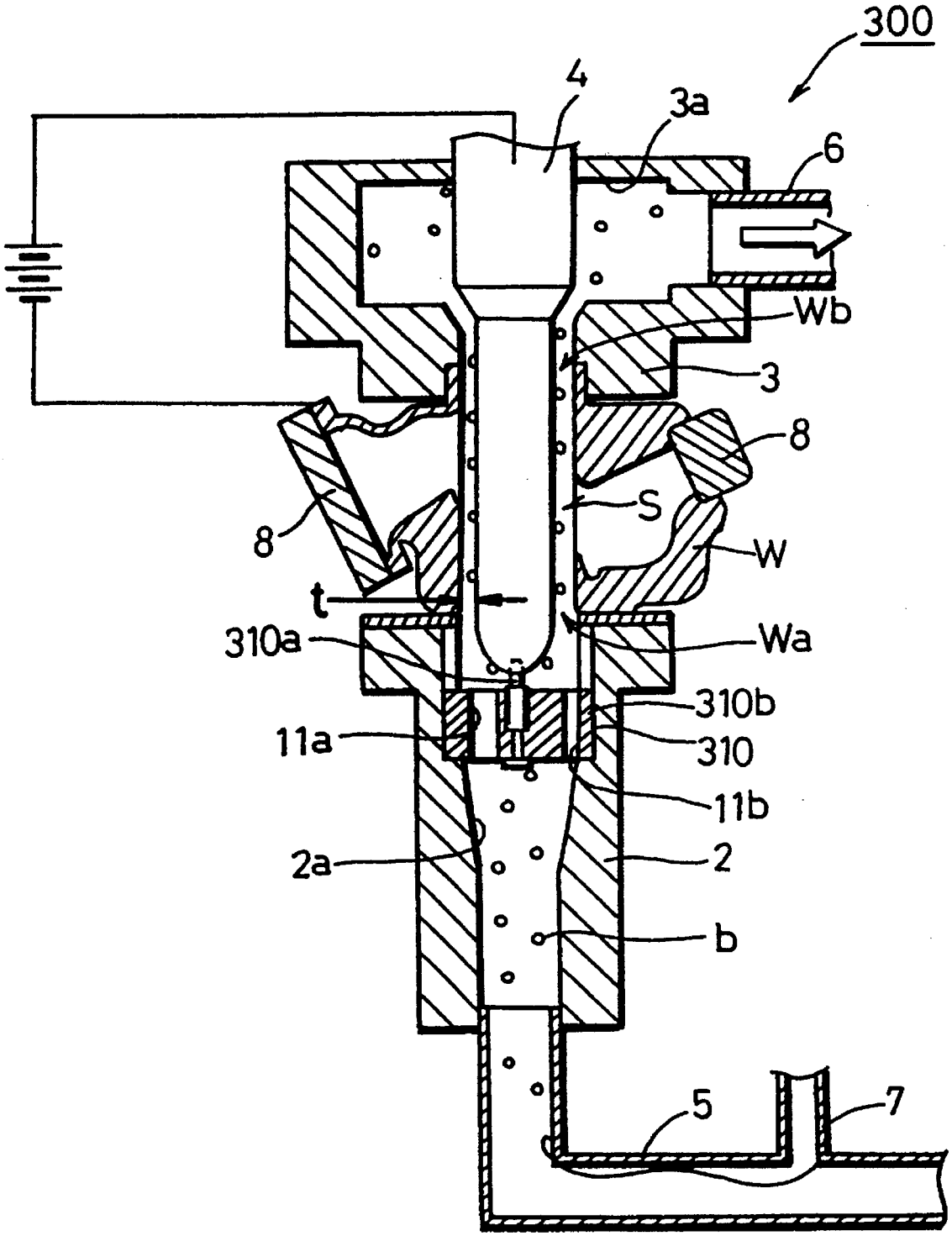
FIG. 8 is a longitudinal sectional view showing a main part of a composite plating apparatus according to a third embodiment of the present invention.
Figure 9:
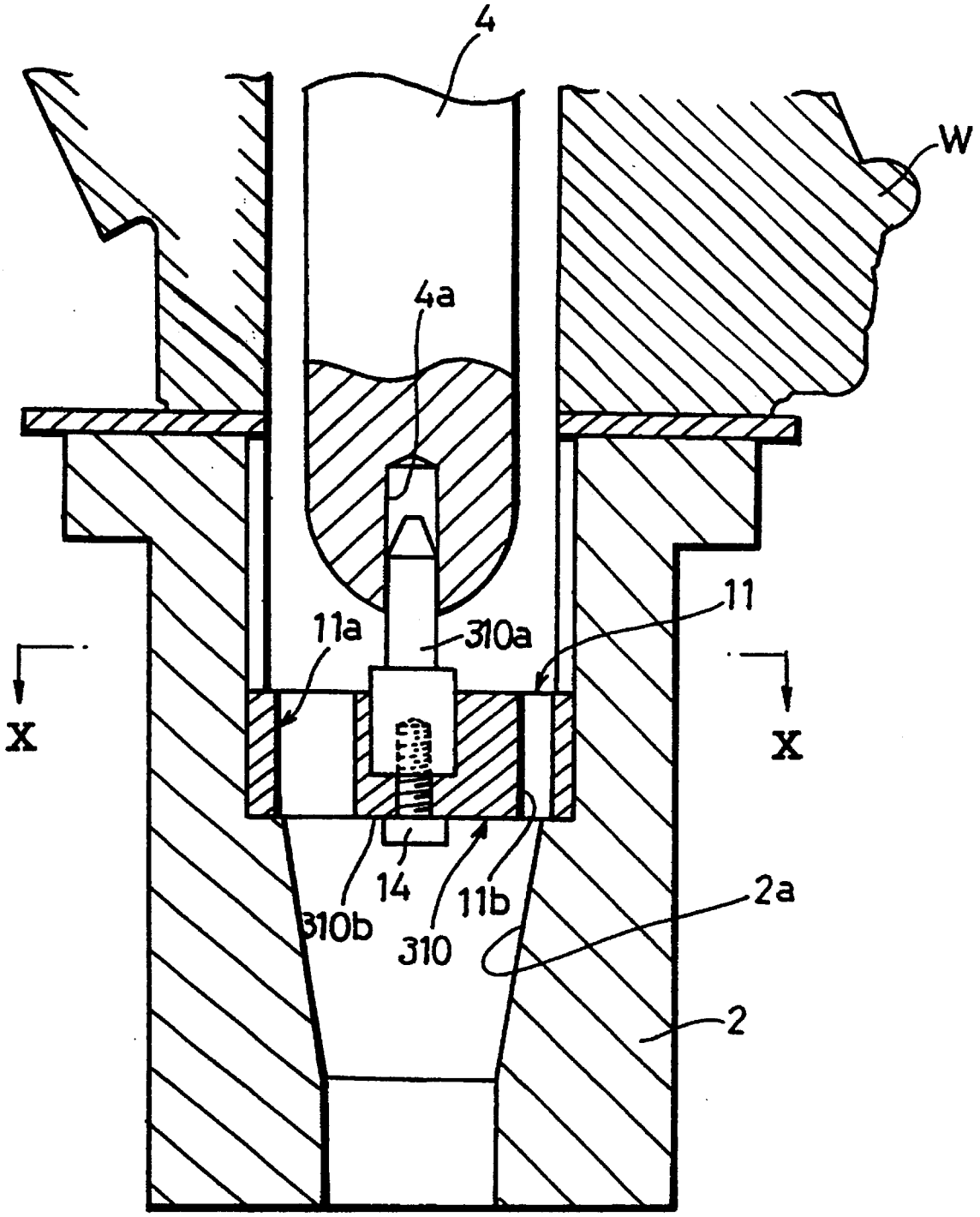
FIG. 9 is a partially enlarged sectional view of a composite plating apparatus shown in FIG. 8.
Figure 10:
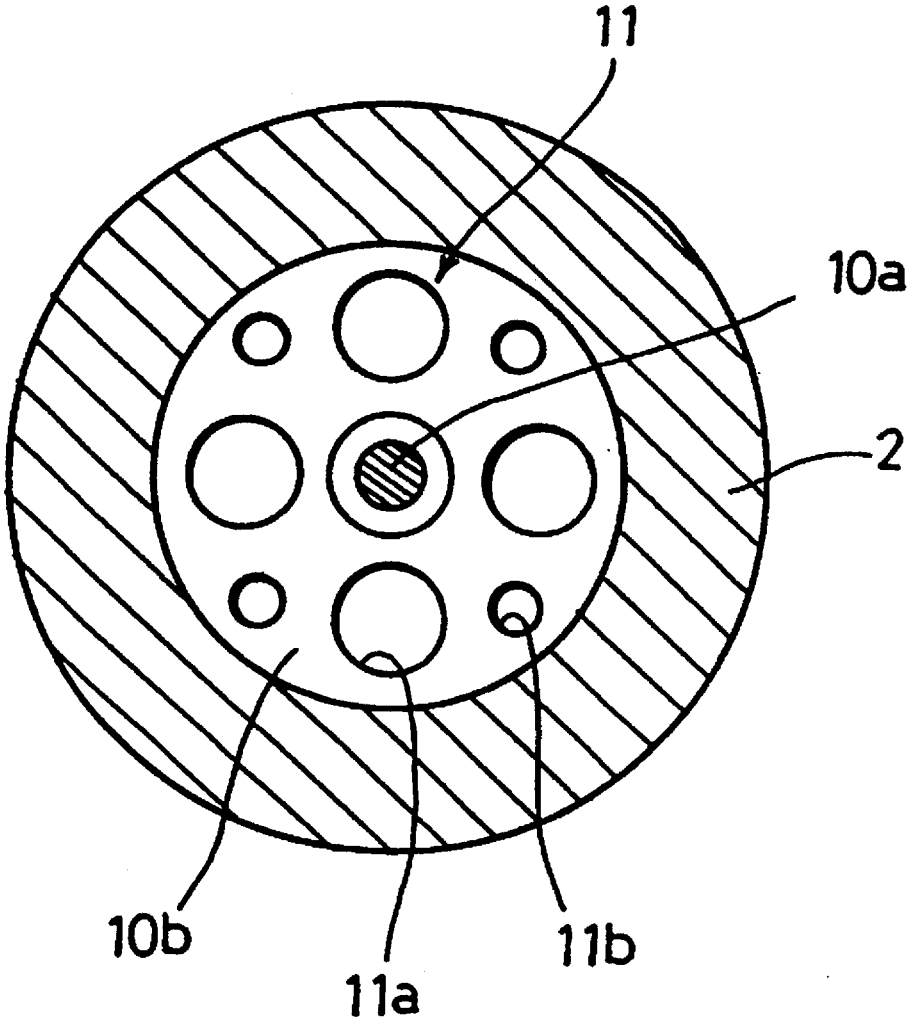
FIG. 10 is a cross sectional view taken on line X—X of FIG. 9 showing a second pattern of the passage holes (large and small holes) formed in an air bubble dispersing member or an electrode engaging member used in the composite plating apparatus according to the third embodiment.

FIG. 8 is a longitudinal sectional view of a composite plating apparatus according to a third embodiment of the present invention, FIG. 9 is a partially enlarged sectional view of a main part shown in FIG. 8, and FIG. 10 is a cross sectional view taken on line X—X in FIG. 9.

As shown in FIGS. 8 and 9, a composite plating apparatus 300 according to the third embodiment of the present invention is provided with an electrode engaging member 310 or an air bubble dispersing member 310 including an electrode engaging means in the midpoint of the communicating hole 2*a* of the jig pad 2 in the same manner as that of the embodiments as described above.

The air bubble dispersing member 310 includes a supporting portion 310*b* held by the jig pad 2 and the engaging portion 310*a* secured to the center of the supporting portion 310 by a screw 14 so that a tip end portion of the engaging portion 310*a* is fitted into an engaging hole 4*a* formed in the end tip portion of the insertion electrode 4. The base end portion of the insertion electrode 4 is supported by the holding jig 3 or a supporting means (not shown) arranged above the holding jig 3, in the same manner as that of the embodiments as described above. In this manner, both of the base end portion and the tip end portion of the insertion electrode 4 are supported.

A plurality of plating solution passage holes 11 are formed in the supporting portion 310*b* along the circumference thereof. As shown in FIG. 10, these plating solution passage holes 11 are formed as a combination of large diameter holes 11*a* and small diameter holes 11*b*, and the sum of the cross-sectional areas of all of these holes is approximately equal to the area of the annular space S defined between the inner surface of the cylinder and the outer surface of the insertion electrode 4 in the cylinder. That is to say, the air bubble dispersing member 310 of this embodiment has the approximately same constitution as the air bubble dispersing member 10 having the second pattern of passage holes shown in FIG. 3 but differs from the air bubble dispersing member 10 in that it includes the engaging means (engaging portion 310*a*) at the center portion thereof for engaging the insertion electrode 4.

Figure 11:
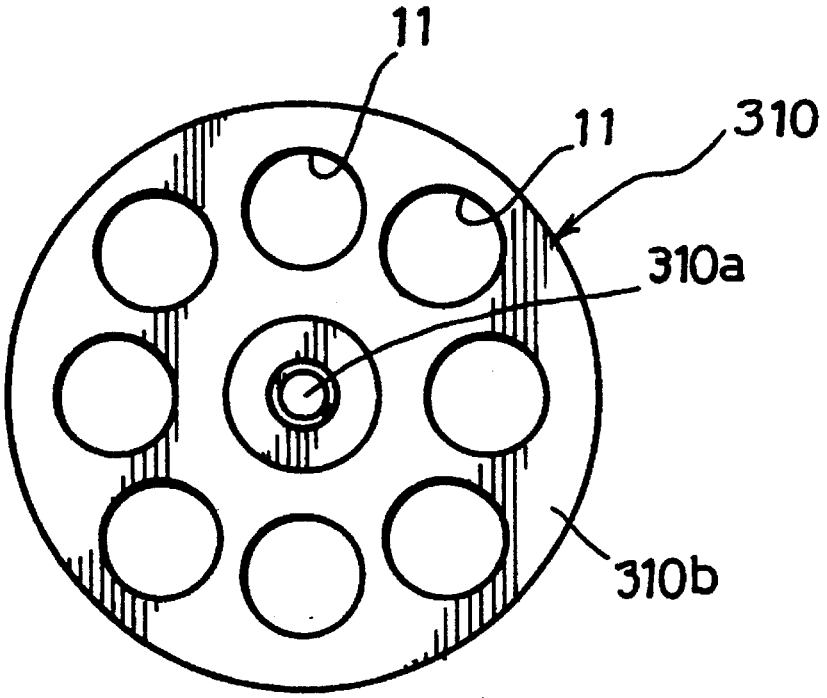
FIG. 11 is a plan view of the air bubble dispersing member used in the composite plating apparatus according to the third embodiment in which a first pattern of the passage holes (a plurality of passage holes each having the same diameter) is formed therein.

In order to prevent deterioration of the rigidity of the supporting portion 310*b*, large diameter holes and small diameter holes are formed in combination in the plating solution passage holes 11. Of course, as shown in FIG. 11, a plurality of passage holes each having the same diameter may be equally formed with the equal angle along the circumference of the supporting portion 310*b* of the air bubble dispersing member 310 so that the pattern of the passage holes is approximately the same as the first pattern of the passage holes shown in FIG. 2.

The operation of the composite plating apparatus 300 constructed as described above will now be described.

The cylinder block W is mounted On the regular position of the jig pad 2. The cylinder block W is held from above by the holding jig 3, and the insertion electrode 4 is inserted into the cylinder to fit the engaging hole 4*a* of the tip end or lower end portion thereof into the engaging portion 310*a* of the air bubble dispersing member 310. By this, the positioned cylinder block W and the insertion electrode 4 positioned at the predetermined position are precisely aligned and the annular space S in the cylinder can be set so that it is uniform over the entire circumference of the inner surface of the cylinder.

When the composite plating solution is fed through the liquid feeding pipe 5 and the air is fed in the composite plating solution through the air feeding pipe 7, the composite plating solution including air bubbles flow towards the plating solution inlet portion Wa. The composite plating solution including air bubbles pass through the plating solution passage holes 11 of the air bubble dispersing member 310, and flows smoothly without significantly changing its upwardly flowing direction. Further, since the sum of the areas of the passage holes 11 for passing the plating solution therethrough is approximately equal to the area of the space S, the plating solution can flow smoothly. The flow rate of the plating solution in the cylinder is set, for example, at about 15 cm/s.

When a voltage is applied between the insertion electrode 4 and the cylinder block W, nickel and silicon carbide are deposited from the flowing composite plating solution to form a deposit on the inner surface of the cylinder. The cathode current density at this time is approximately 28 $A/dm^2$.

Since the gap of the space S can be made uniform over the entire circumferential direction of the cylinder, a deposit of uniform thickness can be formed. Also the air bubbles b move upwards more quickly than the composite plating solution in the space S and work so that the fine grains of silicon carbide are pressed onto the inner surface of the cylinder, deposition of the fine grains is increased.

Figure 12:
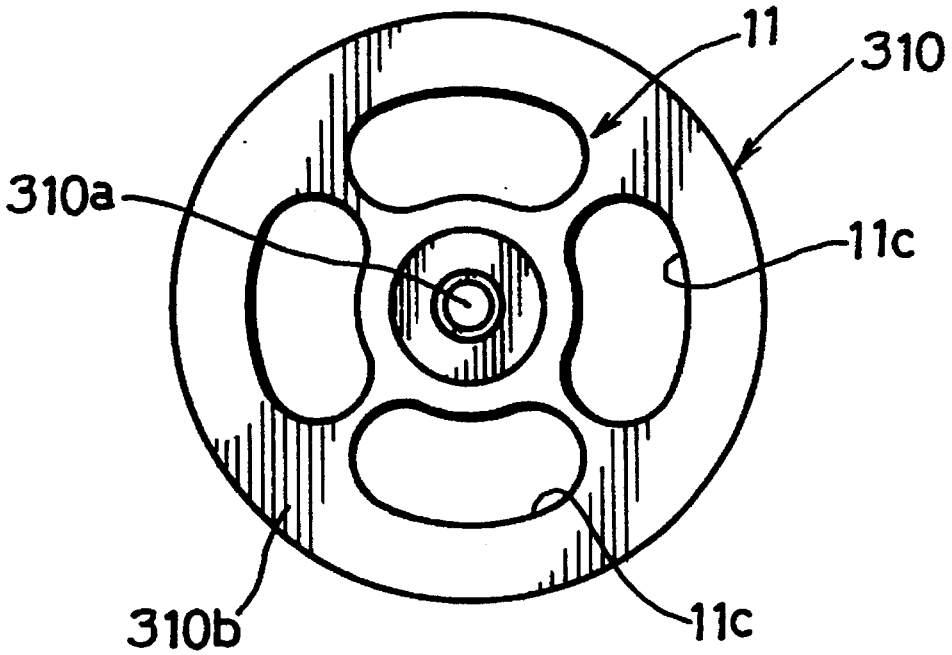
FIG. 12 is a plan view of the air bubble dispersing member used in the composite plating apparatus according to the third embodiment in which a third pattern of the passage holes (passage holes are formed into slots) is formed therein.

The air bubble dispersing member 310 shown in FIG. 12 has a pattern of the passage holes which is approximately the same as the third pattern of the passage holes formed in the air bubble dispersing member 10 as shown in FIG. 4, in which the plating solution passage holes 11 are formed into the slots 11*c* so as to improve the effect of the fine grains being pressed to the inner surface of the cylinder by the air bubbles b. In this case, four slots or oblong holes 11*c* are formed on the air bubble dispersing member 10 and spaced from each other by an equivalent angular distance on the periphery thereof so that the diameter of the outer circular arcs of the slots 11*c* approximately match the internal diameter of the cylinder and the diameter of the inner circular arcs of the same approximately match the outer diameter of the insertion electrode 4. However, the air bubble dispersing member 310 differs from the air bubble dispersing member 10 shown in FIG. 4 in that it includes the electrode engaging means (engaging portion 310*a*).

Therefore, in this case, large bubbles b can also be flowed in the space S end the effect of the fine grains in the plating solution being pressed to the inner surface of the cylinder can be improved, as in the case of air bubbles dispersing member shown in FIG. 4.

Figure 13:
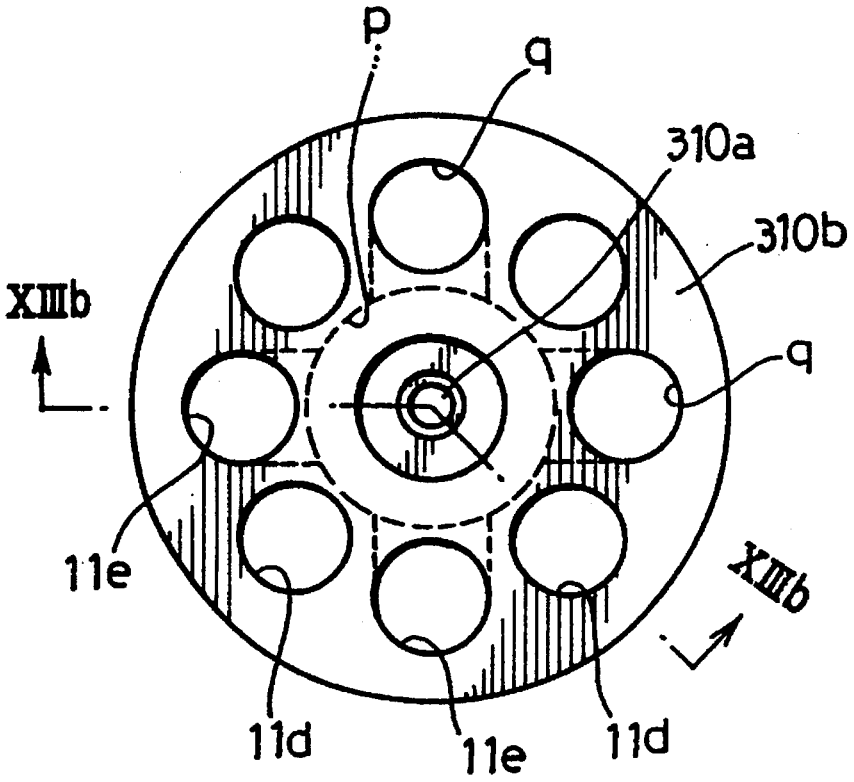
FIG. 13(*a*) is a plan view of the air bubble dispersing member used in the composite plating apparatus according to the third embodiment in which a fourth pattern of the passage holes (combination of direct passage holes and dispersing holes) is formed therein.
Figure 13:
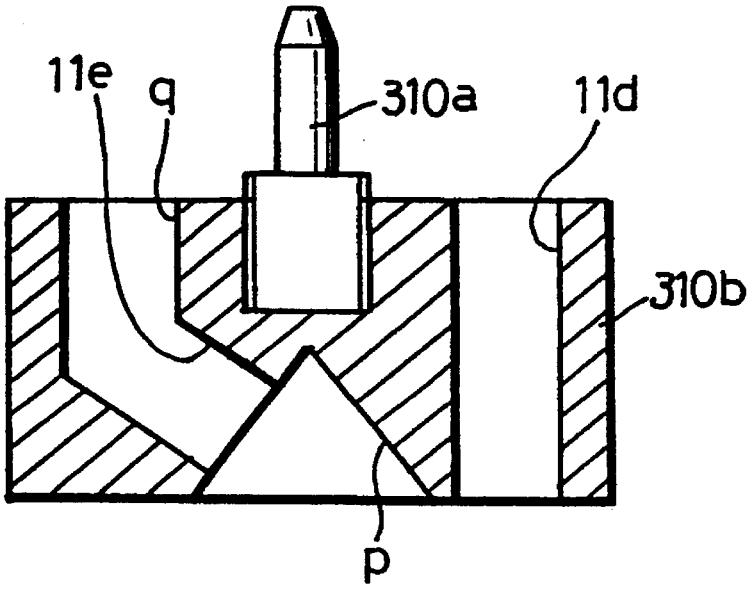

FIGS. 13(*a*) and 13(*b*) show the air bubble dispersing member 310 for dispersing the air bubbles b uniformly in the space S in which direct passage holes 11*d* merely pass the plating solution in an upward direction and dispersing holes 11*e* formed in the upper face of the dispersing member 310, communicate with a central hole p formed in the lower face of the air bubble dispersing member 310 and are repeated in the air bubble dispersing member 310 alternatively four times along the circumference. The air bubble dispersing member 310 shown in FIGS. 13(*a*) and 13(*b*) has approximately the same constitution and offers the approximately same action and advantage as those of the fourth pattern of the passage holes shown in FIGS. 5(*a*) and 5(*b*). However, the air bubble dispersing member 310 shown in FIGS. 13(*a*) and 13(*b*) differs from the air bubble dispersing member 10 shown in FIGS. 5(*a*) and 5(*b*) in that it includes the electrode engaging means (engaging portion 310*a*).

The engaging portion 310*a* is screwed in the supporting portion 310*a*, as shown in FIG. 13(*b*).

Figure 14:
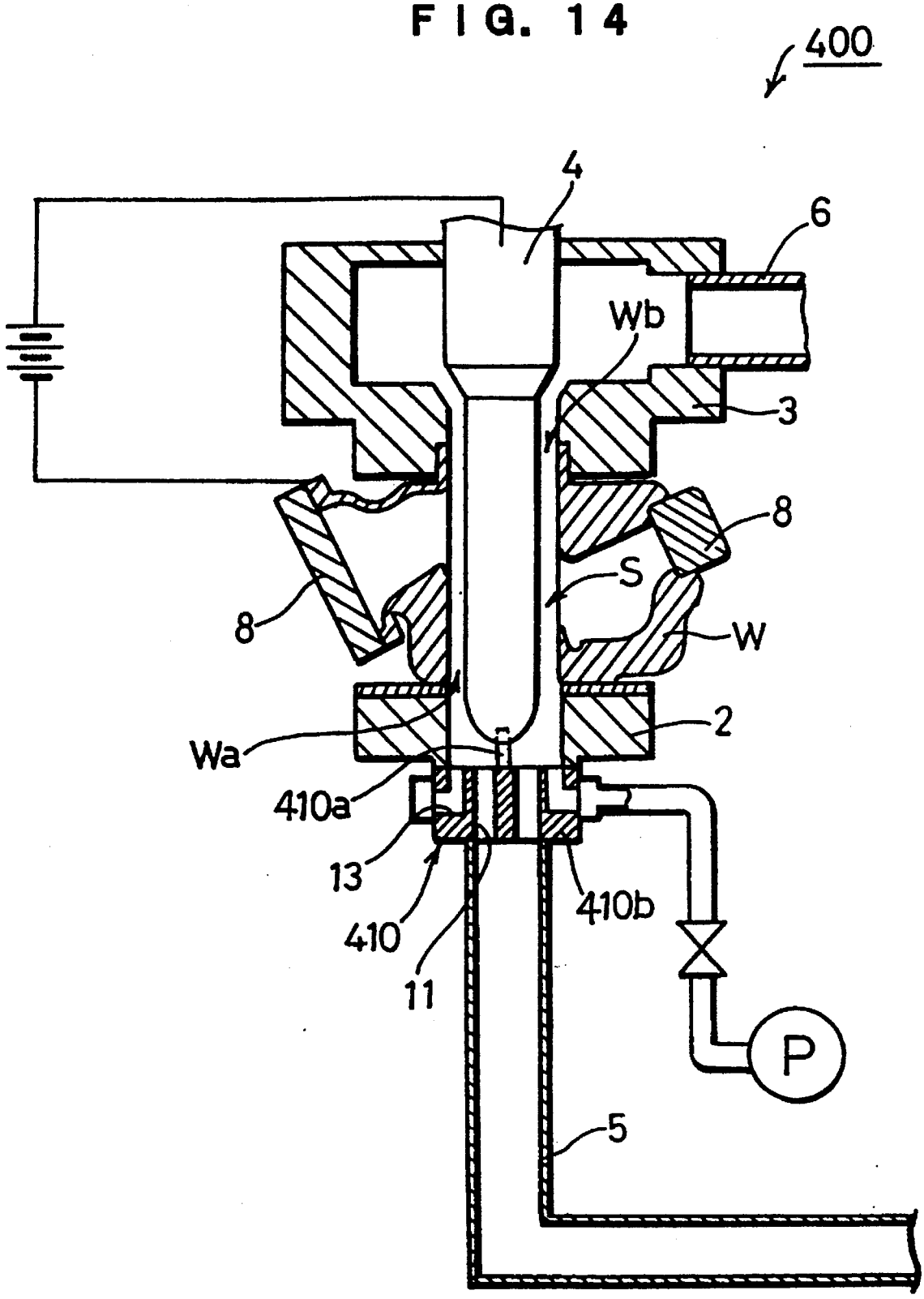
FIG. 14 is a longitudinal sectional view showing a main part of a composite plating apparatus according to a fourth embodiment of the present invention.
Figure 15:
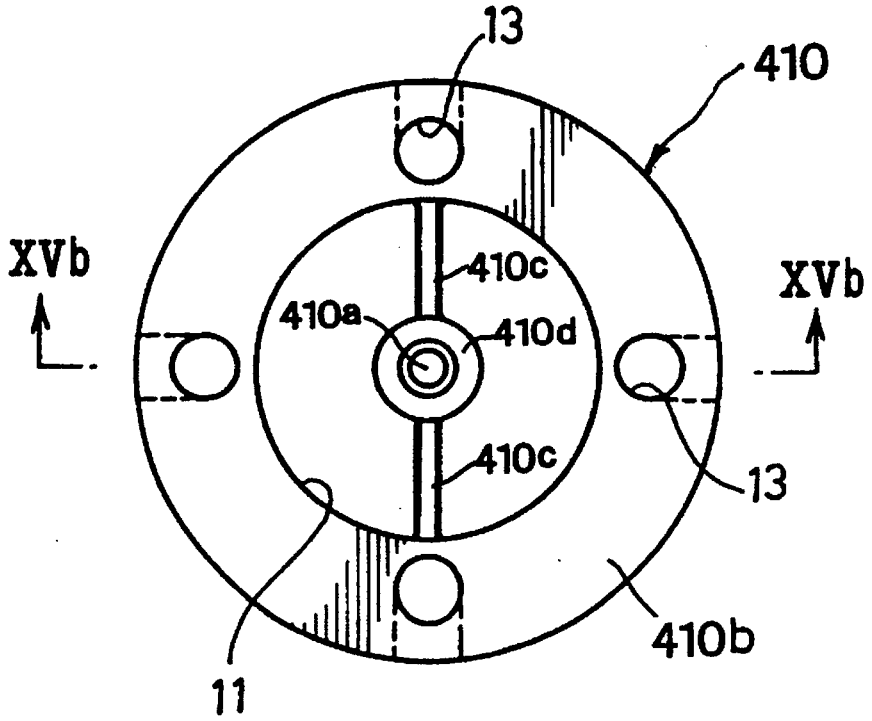
FIG. 15(*a*) is a plan view of an air bubble dispersing member used in the composite plating apparatus shown in FIG. 14.
Figure 15:
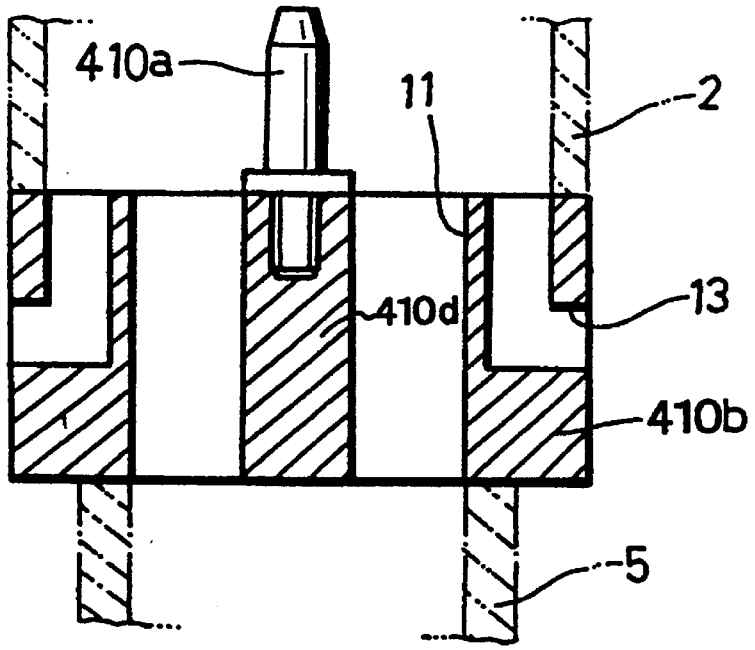
Figure 16:
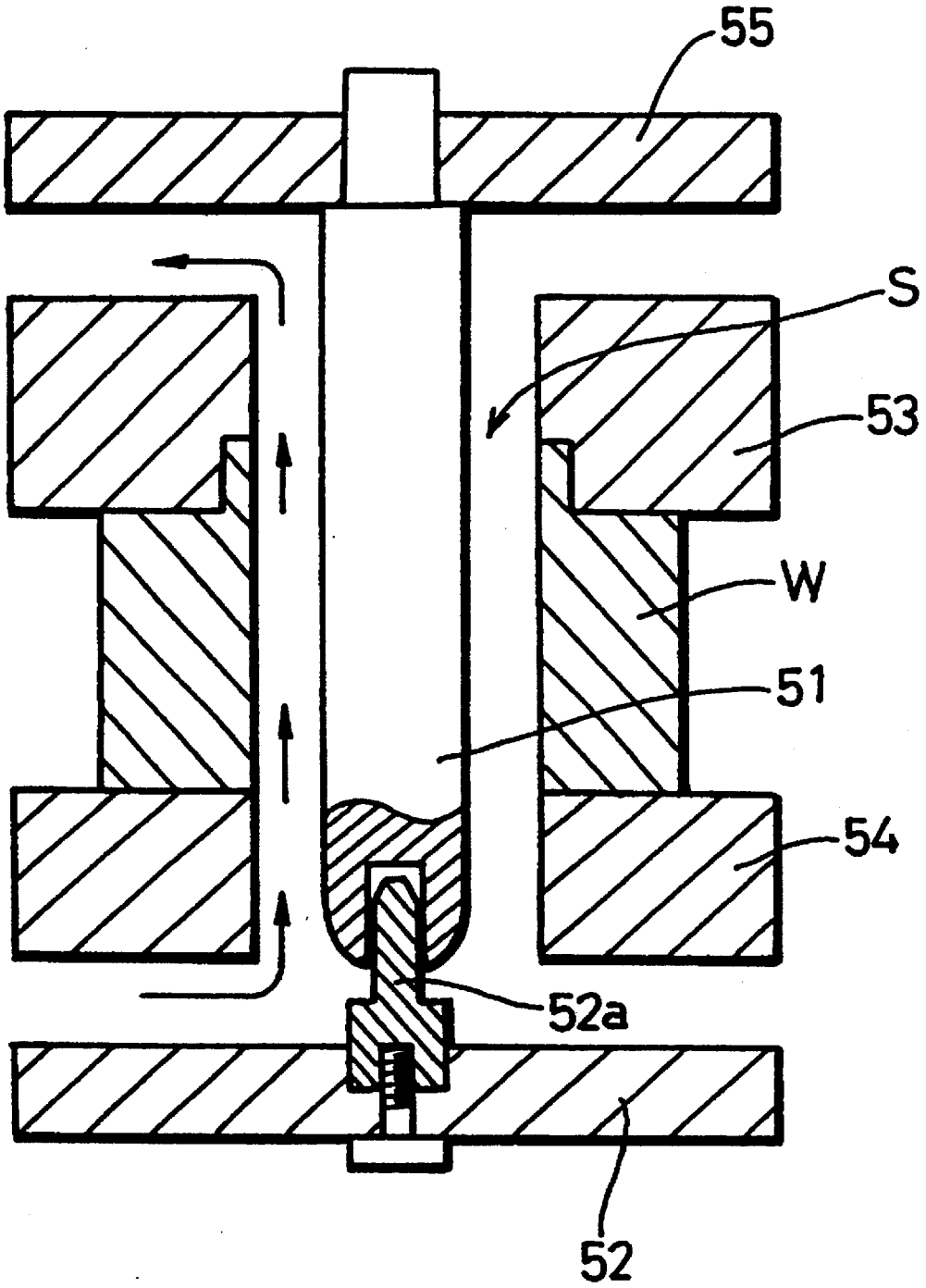
FIG. 16 PRIOR ART
FIG. 16 is a longitudinal sectional view showing a main part of a conventional composite plating apparatus.

A composite plating apparatus 400 according to a fourth embodiment of the present invention will be described with reference to FIGS. 14, 15(*a*) and 15(*b*).

According to the third embodiment as described above, both the plating solution and the air bubbles b, i.e., the composite plating solution flowing in the liquid feeding pipe 5 to which air bubbles b are fed through the air feeding pipe 7, are passed through various passage holes 11 formed in the air bubble dispersing member 310. However, in a bubble dispersing member 410 of a composite plating apparatus 400 shown in FIGS. 14, 15(*a*) and 15(*b*) as the fourth embodiment of the present invention, a plating solution passage hole 11 and air feeding holes 13 are formed to be separate and distinct from one another approximately as in the case of the second embodiment as described above. Thus, in this embodiment, the air is fed through the air feeding holes 13 in place of the air feeding pipe 7 shown in FIG. 8. And, four air feeding holes 13 are, for example, equally spaced along the circumferential direction of the air bubble dispersing member 410, and the dispersion of the air bubbles b can be effectively controlled because the air can be fed from any direction. In this case, a core portion 410*d* is supported by a pair of brackets 410*c* stretching toward the center of the plating solution passage hole 11, and an engaging portion 410*a* is attached to the core portion 410*d*. The dispersion of the air bubbles b can also be effectively controlled.

As has been described above, in the composite plating apparatus according to the third and fourth embodiments of the present invention, a tip end portion of the insertion electrode is engaged with the air bubble dispersing member. Therefore, the position of the insertion electrode can be stabilized, a gap formed between the insertion electrode and the inner surface of a hollow cylinder can be held constant, and the deposit thickness can be formed uniformly accompanying the action and effect of the first and second embodiments as described above.

What is claimed is:

1. An apparatus for plating an inner surface of a hollow cylinder having an inner surface and an axis, the apparatus comprising:

an upper plating jig and a lower plating jig adapted to hold said hollow cylinder therebetween, said upper plating jig having an opening which is aligned with the inner surface of the hollow cylinder in use and which serves as an outlet for composite plating solution, said lower plating jig having an opening which is aligned with the inner surface of the hollow cylinder in use and which serves as an inlet for the composite plating solution;

an insertion electrode for insertion within the opening of the upper plating jig and the hollow cylinder, the electrode being generally co-axial with the axis of the hollow cylinder to define an annular gap between said insertion electrode and the aligned opening of the upper plating jig and inner surface of the hollow cylinder;

a support member to support an upper portion of said insertion electrode when positioning said insertion electrode within the upper plating jig and hollow cylinder;

a liquid feeding pipe to supply the composite plating solution through the opening of the lower plating jig to the hollow cylinder and to flow the composite plating solution through said annular gap;

a bubble source to provide air bubbles for mixing in said plating solution within the hollow cylinder;

and a bubble dispersing member positioned downstream of the liquid feeding pipe and upstream of the opening of the lower plating jig to disperse said air bubbles in said composite plating solution within the hollow cylinder, said bubble dispersing member having a plurality of passage holes therethrough, at least a first passage hole of said plurality of passage holes having a diameter larger than a width of said annular gap, and at least a second passage hole of said plurality of passage holes being shaped as a slot.

2. An apparatus according to claim 1, wherein a sum of cross-sectional areas of all passage holes of said plurality of passage holes is approximately equal to a cross-sectional area of said annular gap.

3. An apparatus according to claim 1, wherein said air bubble dispersing member includes an inlet surface and an outlet surface, and a central hole at a center of said inlet surface is in flowing communication with a plurality of peripheral holes on a peripheral portion of said outlet surface.

4. An apparatus according to claim 1, wherein said plurality of passage holes comprises a first set of holes for passing the composite plating solution through said air bubble dispensing member from said liquid feeding pipe to the hollow cylinder, and a second set of holes for for feeding gases through said air bubble dispensing member from said air bubble source to the hollow cylinder, said first set of holes being separate from said second set of holes.

5. An apparatus for plating an inner surface of a hollow cylinder having an inner surface and an axis, the apparatus comprising:

an upper plating jig and a lower plating jig adapted to hold said hollow cylinder therebetween, said upper plating jig having an opening which is aligned with the inner surface of the hollow cylinder in use and which serves as an outlet for composite plating solution, said lower plating jig having an opening which is aligned with the inner surface of the hollow cylinder in use and which serves as an inlet for the composite plating solution;

an insertion electrode for insertion within the opening of the upper plating jig and the hollow cylinder, the electrode being generally co-axial with the axis of the hollow cylinder to define an annular gap between said insertion electrode and the aligned opening of the upper plating jig and inner surface of the hollow cylinder;

a support member to support an upper portion of said insertion electrode when positioning said insertion electrode within the upper plating jig and hollow cylinder;

a liquid feeding pipe to supply the composite plating solution through the opening of the lower plating jig to the hollow cylinder and to flow the composite plating solution through said annular gap; and an electrode engaging member positioned downstream of the liquid feeding pipe and upstream of the opening of the lower plating jig to engage a lower tip end of said insertion electrode, said electrode engaging member having a plurality of passage holes to permit flow communication between said liquid feeding pipe and the hollow cylinder, said plurality of passage holes including large holes having a diameter larger than a width of said annular gap and small holes having a diameter smaller than the width of said annular gap.

6. An apparatus according to claim 5, wherein said plurality of passage holes of said electrode engaging member are formed of a plurality of slots.

7. An apparatus according to claim 5, wherein a sum of cross-sectional areas of all passage holes of said plurality of passage holes of said electrode engaging member is approximately equal to a cross-sectional area of said annular gap.

8. An apparatus according to claim 5, wherein said electrode engaging member includes an inlet surface and an outlet surface, and said plurality of passage holes includes a central hole opened on a center of said inlet surface and in flowing communication with a plurality of peripheral holes at a peripheral portion of said outlet surface.

9. An apparatus according to claim 5, wherein a first part of said plurality of passage holes of said electrode engaging member allows flowing communication of said composite plating solution from said liquid feeding pipe to inside of the hollow cylinder and a remaining part of said plurality of passage holes are formed as gas feeding holes to feed gas from a gas source to the hollow cylinder.

10. An apparatus for plating an inner surface of a hollow cylinder having an inner surface and an axis, the apparatus comprising:

an upper plating jig and a lower plating jig adapted to hold said hollow cylinder therebetween, said upper plating jig having an opening which is aligned with the inner surface of the hollow cylinder in use and which serves as an outlet for composite plating solution, said lower plating jig having an opening which is aligned with the inner surface of the hollow cylinder in use and which serves as an inlet for the composite plating solution;

an insertion electrode for insertion within the opening of the upper plating jig and the hollow cylinder, the electrode being generally co-axial with the axis of the hollow cylinder to define an annular gap between said insertion electrode and the aligned opening of the upper plating jig and inner surface of the hollow cylinder;

a support member to support an upper portion of said insertion electrode when positioning said insertion electrode within the upper plating jig and hollow cylinder;

a liquid feeding pipe to supply the composite plating solution through the opening of the lower plating jig to the hollow cylinder and to flow the composite plating solution through said annular gap;

a bubble source to provide air bubbles for mixing in said plating solution within the hollow cylinder; and a bubble dispersing member positioned downstream of the liquid feeding pipe and upstream of the opening of the lower plating jig to disperse said air bubbles in said composite plating solution within the hollow cylinder, said bubble dispersing member having a plurality of passage holes therethrough, at least a first passage hole of said plurality of passage holes having a diameter larger than a width of said annular gap.

* * * * *